US009207587B2

(12) United States Patent
Yasutomi

(10) Patent No.: US 9,207,587 B2
(45) Date of Patent: Dec. 8, 2015

(54) IMAGE FORMING METHOD AND IMAGE FORMING DEVICE

(71) Applicant: MITSUBISHI CHEMICAL CORPORATION, Tokyo (JP)

(72) Inventor: Shiro Yasutomi, Niigata (JP)

(73) Assignee: MITSUBISHI CHEMICAL CORPORATION, Tokyo (JP)

( * ) Notice: Subject to any disclaimer, the term of this patent is extended or adjusted under 35 U.S.C. 154(b) by 0 days.

(21) Appl. No.: 14/670,663

(22) Filed: Mar. 27, 2015

(65) Prior Publication Data

US 2015/0205233 A1 Jul. 23, 2015

Related U.S. Application Data

(63) Continuation of application No. PCT/JP2013/070634, filed on Jul. 30, 2013.

(30) Foreign Application Priority Data

Sep. 28, 2012 (JP) ..... 2012-217165
Jul. 2, 2013 (JP) ..... 2013-139142

(51) Int. Cl.
*G03G 15/20* (2006.01)
*G03G 15/01* (2006.01)
*G03G 9/08* (2006.01)

(52) U.S. Cl.
CPC ..... *G03G 15/2014* (2013.01); *G03G 15/01* (2013.01); *G03G 9/08* (2013.01);
(Continued)

(58) Field of Classification Search
CPC ..... G03G 15/20
USPC ..... 399/320–321
See application file for complete search history.

(56) References Cited

U.S. PATENT DOCUMENTS 5,162,860 A * 11/1992 Nami et al. ..... 358/501
2004/0131403 A1* 7/2004 Nakamura et al. ..... 399/341
(Continued)

FOREIGN PATENT DOCUMENTS

EP 0965891 A 12/1999
JP 2011-081042 * 4/2011 ..... G03G 9/08
JP 2011-081042 A 4/2011

OTHER PUBLICATIONS

BAM Corporation, RAU-UZ 122 'Test Method for the Determination of Emissions from Hardcopy Devices with respect to awarding the environmental label for Offices devices with printing function', Appendix 2, May 2009.*
(Continued)

*Primary Examiner* — Clayton E Laballe
*Assistant Examiner* — Kevin Butler
(74) *Attorney, Agent, or Firm* — Leason Ellis LLP

(57) ABSTRACT

The invention relates to an image forming method and an image forming device using at least four color toners of yellow, magenta, cyan and black, and having a fixation step of fixing a toner image on a recording medium using a fixing unit, wherein the total of a dust emission amount from each toner is controlled to be not more than a specific level, and wherein just before the fixation step where the three color toners of yellow, magenta and cyan are laminated on the recording medium, a dust emission amount from the toner to be the outermost layer on the recording medium and a dust emission amount from the toner to be the lowermost layer thereon are controlled to be in a specific relationship therebetween.

10 Claims, 2 Drawing Sheets

(52) U.S. Cl.
CPC ..... *G03G 15/0105* (2013.01); *G03G 15/2075* (2013.01); *G03G 2215/2074* (2013.01); *G03G 2215/2083* (2013.01)

(56) References Cited

U.S. PATENT DOCUMENTS

2008/0241719 A1 10/2008 Niwa
2009/0111040 A1* 4/2009 Veregin et al. ..... 430/108.3
2012/0231383 A1* 9/2012 Santo et al. ..... 430/105
2015/0017583 A1* 1/2015 Ota et al. ..... 430/109.1

OTHER PUBLICATIONS

ECMA International, 'Standard ECMA-328 Determination of Chemical Emission Rates from Electronic Equipment', 6th Edition, Dec. 2013.*
PCT/JP2013/070634, 'Written Opinion of the International Searching Authority', Aug. 27, 2013.*
Extended European Search Report mailed Sep. 4, 2015 for the corresponding European Application No. 13842031.0.

* cited by examiner

IMAGE FORMING METHOD AND IMAGE FORMING DEVICE

TECHNICAL FIELD

The present invention relates to an image forming method for use in electrophotographic copiers and image forming devices, and to an image forming device using the method.

BACKGROUND ART

With the recent popularization of copiers, printers and the like, environmental regulations on human health in office environments have become established mainly in Europe. Further, in high-speed printing, the amount of the toner to be consumed per unit time for development of electrostatic images increases, and therefore more volatile organic compounds and dust would be thereby diffused.

In addition, the arena of electrophotography is expanding not only in the field of letter printing for the past office use or the like but also in the field of graphic use for photographic printing and others, and the amount per sheet of the toner to be used for development of electrostatic images is increasing exponentially.

With such changes in needs, calls to providing a toner for development of electrostatic images that would hardly diffuse volatile organic compounds and dust even in a case where the amount of the toner to be consumed per unit time for development of electrostatic images is large in high-speed mass-scale printing are being strengthened year by year.

Recently, image forming devices certified by the most strict environmental standard, "The Blue Angel" have become increasing, and in electrophotographic fixation systems, the substances that are generated during high-temperature fixation and diffused out of the systems, concretely, dust by sublimation substances and volatile organic compounds are desired to be not more the controlled level regulated in ECMA-328/RAL_UZ122.

Also in Japan, as the certification standards for the ecology mark for copiers, duplicators and the like, the regulation values of RAL_UZ122 are employed as they are at the time of re-revision in 2008, and the related devices are required to satisfy the standards.

The majority of causative substances for the dust that is a substance to be generated and diffused out of systems during high-temperature fixation are the wax components contained in toner. In a high-temperature fixer where papers with a toner transferred thereon are led to pass therethrough for fixation thereon, the wax in the toner not only melts to exhibit a release effect but also partly sublimes to cause dust emission. Dust is a result of the physical sublimation phenomenon of the wax components, and therefore it is desired to provide a method of inhibiting sublimation itself of wax.

In general, wax having good releasability tends to provide a large amount of dust. This is because, the wax that may readily bleed out of a binder resin during fixation is non-polar and is therefore non-compatible with a binder resin, or has a low molecular weight and therefore has a low melt viscosity. The wax of the type a weak intermolecular force between the wax molecules or between the wax molecule and the binder resin, and therefore may often sublime during fixation to form dust.

On the contrary, those having polarity such as ester wax and the like, or high-molecular-weight waxes, and further those having a high content of unnormalized forms such as iso-form, cyclic form and the like of hydrocarbon waxes hardly bleed out during fixation owing to the above-mentioned intermolecular force and to entanglement of wax molecular chains, and in general, therefore, they tend to be relatively poor in releasability but they hardly sublime and the dust emission amount from them is small. In other words, it may be said that releasability performance and environmental performance are warring concepts.

Under the trend as above, for example, PTL 1 proposes a toner for development of electrostatic images which satisfies both low-temperature fixation capability and blocking resistance while preventing dust emission during fixation.

CITATION LIST

Patent Literature

PTL 1: JP-A 2011-81042

SUMMARY OF INVENTION

Technical Problem

However, the toner for development of electrostatic images proposed by PTL 1 is excellent in low-temperature fixation capability and blocking resistance while preventing dust emission during fixation, as using a specific wax, but could not satisfy hot offset resistance.

Hot offset resistance as referred to herein means the performance of preventing the phenomenon of generating gloss unevenness that is referred to as blister to cause image degradation, which may occur owing to the release insufficiency and the internal cohesion power insufficiency of toner in melting of the toner by the heat given by a fixing device to lower the viscosity thereof, whereby the toner also adheres to the fixing roller side or the toner partially spread between the fixing roller and paper returns back to the paper side.

In electrophotography, in general, two or three color toners of yellow, magenta and cyan are laminated and printed in any desired ratio to give a full color image. For example, FIG. 1 shows a schematic view of a case where magenta, yellow and cyan are laminated on a printing medium. In this, magenta is on the side nearest to the printing medium, and cyan is on the outermost side to form an image. In a fixation step, a fixing roller is to be brought into contact with the cyan toner on the outermost side.

In general, in graphical image printing of, for example, photographs and the like, the area where multicolor toners are laminated greatly increases as compared with that in a case of monochromatic printing of mainly documents, and in the former, therefore, the toner adhering amount per unit area increases. When the toner adhering amount is large, then the quantity of heat to be imparted to the toner in the fixation step is relatively small, and therefore, in such a case, it is known that wax melting and bleeding may reduce and the releasability of toner from a fixing roller would worsen. In other words, in graphical image printing in which the toner adhering amount is large, high-temperature fixation failure (=hot offset) tends to occur frequently.

Consequently, in an electrophotographic device expected for graphic use, improvement of releasability from a fixing roller has been tried by using wax having good releasability or by increasing the amount of wax to be added. However, as described above, dust emission amount increases in such methods. Recently, further, high-speed image formation processes are growing from the viewpoint of productivity improvement, and therefore, dust emission amount per unit time tends to increase more and more. In other words, the above answers are unfavorable from the viewpoint of reducing users' machine usable environment loads.

On the other hand, for the same purpose as above, solving the problem of hot offset is tried by crosslinking resins or by increasing the molecular weight of resins. According to this, the problem of hot offset could be solved with no increase in dust emission amount, but the gloss of the fixed image lowers. In graphic use, images are required to be highly glossy like those in silver halide photography, and therefore reduction in the gloss of printed images is unfavorable.

An object of the present invention is to provide an image forming method and an image forming device capable of realizing excellent image quality, in which, while dust emission amount during fixation is reduced, the hot offset resistance in graphic use where the amount of toner to adhere to paper for development of electrostatic images thereon increases, is improved.

Solution to Problem

The present inventors have assiduously studied in consideration of the above-mentioned problems and, as a result, have found that, in an image forming method that use at least four color toners of yellow, magenta, cyan and black and comprises a fixation step of fixing a toner image using a fixing unit, when the total of the dust emission amount from each toner is controlled to be not more than a specific level, and at the same time, when the dust emission amount from the toner to be the outermost layer on the recording medium and the dust emission amount from the toner to be the lowermost layer thereon are controlled to be in a specific relationship therebetween, just before the fixation step where the three color toners of yellow, magenta and cyan are laminated on a recording medium, then the above-mentioned problems can be solved.

Specifically, the gist of the present invention resides in the following (1) to (10):

(1) An image forming method using at least four color toners of yellow, magenta, cyan and black, and comprising a fixation step of fixing a toner image on a recording medium using a fixing unit, wherein the total of a dust emission amount from each of the four color toners is less than 16 mg/h, and when, of the yellow toner, the magenta toner and the cyan toner, just before the fixation step, a dust emission amount from the toner to be the outermost layer on the recording medium is represented by A (mg/h), a dust emission amount from the toner to be the interlayer on the recording medium is represented by B (mg/h), a dust emission amount from the toner to be the lowermost layer on the recording medium is represented by C (mg/h), A/C is from 1.5 to 23.7, and A, B and C each satisfy the relationship of $0.9 \leq A < 14.2$, $0.6 \leq B < 14.2$ and $0.6 \leq C < 14.2$.

(2) The image forming method according to the (1) above, wherein the A/C is from 4.0 to 23.7.

(3) The image forming method according to the (1) or (2) above, wherein a mean gloss value in printing solid images of yellow, magenta cyan is from 22.0 to 60.0.

(4) The image forming method according to any one of the (1) to (3) above, wherein at least one toner of the yellow, magenta, cyan and black toners contains a hydrocarbon wax.

(5) The image forming method according to any one of the (1) to (4) above, wherein the toner to be the outermost layer on the recording medium just before the fixation step contains a paraffin wax, and the toner to be the lowermost layer on the recording medium just before the fixation step contains a microcrystalline wax.

(6) An image forming device using at least four color toners of yellow, magenta, cyan and black, and having a fixation step of fixing a toner image on a recording medium using a fixing unit, wherein the total of a dust emission amount from each of the four color toners is less than 16 mg/h, and when, of the yellow toner, the magenta toner and the cyan toner, just before the fixation step, a dust emission amount from the toner to be the outermost layer on the recording medium is represented by A (mg/h), a dust emission amount from the toner to be the interlayer on the recording medium is represented by B (mg/h), a dust emission amount from the toner to be the lowermost layer on the recording medium is represented by C (mg/h), A/C is from 1.5 to 23.7, and A, B and C each satisfy the relationship of $0.9 \leq A < 14.2$, $0.6 \leq B < 14.2$ and $0.6 \leq C < 14.2$.

(7) The image forming device according to the (6) above, wherein the A/C is from 4.0 to 23.7.

(8) The image forming device according to the (6) or (7) above, wherein a mean gloss value in solid image printing with yellow, magenta cyan is from 22.0 to 60.0.

(9) The image forming device according to any one of the (6) to (8) above, wherein at least one toner of the yellow, magenta, cyan and black toners contains a hydrocarbon wax.

(10) The image forming device according to any one of the (6) to (9) above, wherein the toner to be the outermost layer on the recording medium just before the fixation step contains a paraffin wax, and the toner to be the lowermost layer on the recording medium just before the fixation step contains a microcrystalline wax.

Advantageous Effects of Invention

The present invention exhibits advantageous effects of providing excellent image quality and improving hot offset resistance in graphic use where the amount of toner to adhere to paper for development of electrostatic images thereon increases, while dust emission amount during fixation is reduced.

DESCRIPTION OF EMBODIMENTS

The present invention is described below. However, the present invention is not limited to the embodiments given below but can be modified and changed in any desired manner.

<Image Forming Method and Image Forming Device of Invention>

The image forming method and the image forming device of the present invention use at least four color toner of yellow, magenta, cyan and black. In the present invention, the number of the color toners to be used is not limited, but in which, generally used are from 4 to 10 color toners. For clearly describing the present invention, a case of using four color toners of yellow, magenta, cyan and black is described in detail hereinunder as a specific example of the invention.

Figure 1:
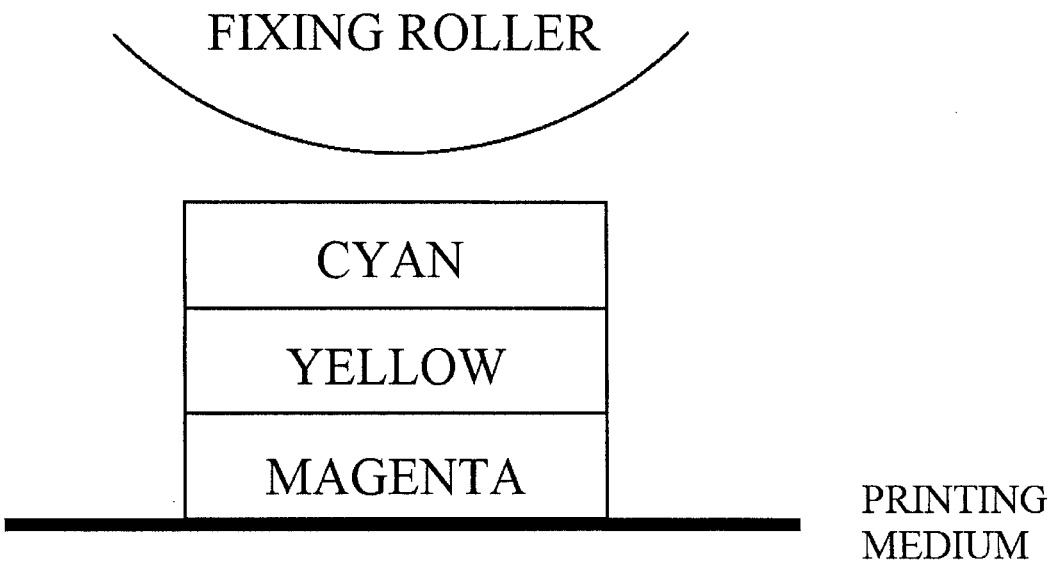
FIG. 1 shows a schematic view in a fixation step in a case where magenta, yellow and cyan toners are laminated in that order from the side near to a printing medium.

The present inventors have found that goodness or badness of hot offset resistance in a case where plural color toners are laminated is dominated by the releasability of toner at the position that is in direct contact with a fixing roller. The reason would be considered as follows: The toner nearer to a fixing roller is given a larger quantity of heat so that the wax therein may melt and bleed out of the binder resin, but on the contrary, the toner remoter from the fixing roller could be given only a slight quantity of heat so that wax could bleed out little, and in addition, the latter toner could not be in direct contact with the roller and therefore would not almost participate in the releasability of the entire toner layer. For example, in FIG. 1, the releasability of the cyan toner has a dominant influence on image fixation, but the yellow toner does not so much have an influence thereon, and the magenta toner has little influence.

Red, green and blue colors each are reproduced by laminating the respective two color toners. For example, in the development color order in FIG. 1, yellow and magenta are laminated in printing in red, and in this case, the yellow toner is in direct contact with the fixing roller.

In this, however, the toner adhering amount is smaller than that in the above-mentioned case of three color lamination, and therefore the releasability that is required for the yellow toner is not so much like in the three layer lamination. In short, in FIG. 1, the order in which the releasability is important is cyan the first, then yellow and magenta the last.

In the present invention, the color lamination order is not so much important, and the color toners may be laminated in any desired color toner with no problem so far as the requirements defined in the present invention are satisfied.

Here, the color order to be developed along the image forming process and the lamination color order in the fixation step are described. In a direct transfer system, the color first developed forms a layer on the side nearer to the printing medium, and the color finally developed is laminated as the outermost layer that is in contact with the fixing roller.

Figure 2:
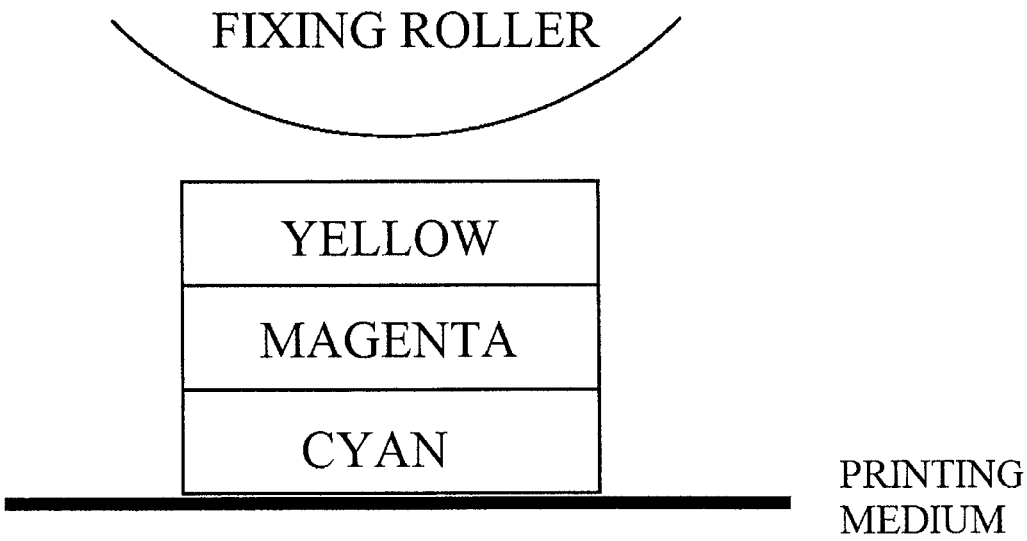
FIG. 2 shows a schematic view in a fixation step in a case where cyan, magenta and yellow toners are laminated in that order from the side near to a printing medium.

For example, FIG. 2 is a schematic view showing the lamination color order in the fixation step in a case where cyan, magenta and yellow are developed in that order in a direct transfer system. In this, the yellow toner developed last forms a layer on the outermost surface that is in contact with a fixing roller.

On the other hand, in a case of an intermediate transfer system, the full color image once formed on an intermediate transcriptional body is transferred onto a printing medium all at a time and therefore, the relationship between the development color order and the lamination color order in the fixation step is contrary to that in the direct transfer system. In other words, the color developed later forms a layer on the side nearer to the printing medium, and the color first developed is laminated on the outermost surface that is in contact with a fixing roller.

Figure 3:
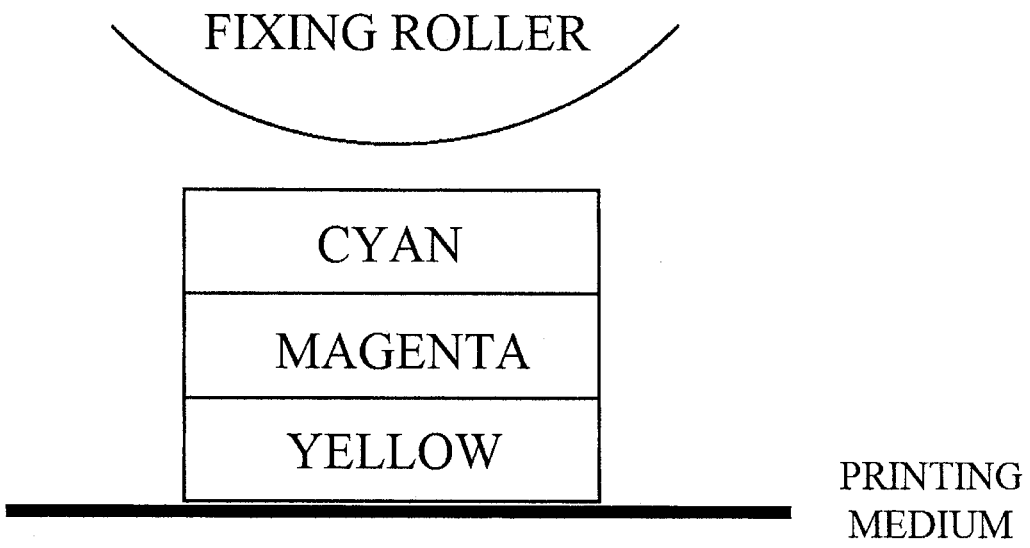
FIG. 3 shows a schematic view in a fixation step in a case where yellow, magenta and cyan toners are laminated in that order from the side near to a printing medium.

For example, FIG. 3 is a schematic view showing the lamination color order in the fixation step in a case where cyan, magenta and yellow are developed in that order in an intermediate transfer system. The development color order is the same as in FIG. 2, but the lamination color order in the fixation step is contrary thereto, and cyan is on the outermost surface.

As described above, the toner lamination color order in a fixation step is specifically noted. When the toner nearer to the fixing roller (or that is, the toner remoter from the recording medium) uses a highly-releasable wax, then the hot offset resistance may be bettered even through the toner adhering amount is large in multiple color lamination. Accordingly, it may be good that the toner remoter from the fixing roller (or that is, the toner nearer to the recording medium) could satisfy hot offset resistance when the adhering amount thereof is small, or that is, during image formation through direct contact of itself with a fixing roller, and therefore, there would occur no practical problem even in use of a wax that is relatively poor in releasability but may generate little dust. As a result, it may be possible to reduce the total dust emission amount in an image forming device.

In other words, the present invention has provided a method of realizing a higher balance than before between high toner adhering amount in graphic use, high gloss and low dust emission amount that are the requirements of the marketplace.

The dust emission amount from each color toner may be measured according to the method to be mentioned hereinunder. It is desirable that, of the yellow toner, the magenta toner and the cyan toner just before the fixation step, the dust emission amount from the toner to be the outermost layer on the recording medium is represented by A (mg/h), the dust emission amount from the toner to be the interlayer on the recording medium is represented by B (mg/h), the dust emission amount from the toner to be the lowermost layer on the recording medium is represented by C (mg/h), and under the condition, it is indispensable to satisfy the relationship of $1.5 \leq A/C \leq 23.7$. More preferably, $4.0 \leq A/C \leq 23.7$, even more preferably $6.0 \leq A/C \leq 20.0$.

When the ratio exceeds the preferred range, then it would be often difficult to satisfy the Blue Angel Standard depending on the image formation process speed and the fixation condition. When the ratio is lower than the preferred range, then the hot offset resistance would be poor and high-quality print images could not be formed.

Regarding the individual values of A, B and C, A is 0.9 or more, preferably 3.0 or more, more preferably 9.0 or more, and is less than 14.2, preferably 14 or less, more preferably 13 or less, even more preferably 11 or less. B is 0.6 or more, preferably 0.65 or more, more preferably 0.7 or more, and is less than 14.2, preferably 10 or less, more preferably 7 or less, even more preferably 5 or less. C is 0.6 or more, preferably 0.65 or more, more preferably 0.7 or more, and is less than 14.2, preferably 10 or less, more preferably 7 or less, even more preferably 5 or less.

However, as described in detail hereinunder relative to the measurement method, the toner dust emission amount detection limit is 0.6 mg/h, and therefore the lower limit of B and C is 0.6 mg/h, which, however, is not limitative. When A, B and C each are more than the upper limit, then it would be often difficult to satisfy the Blue Angel Standard depending on the image formation process speed and on the fixation condition. When the value is lower than the preferred range, then the hot offset resistance would be poor and high-quality print images could not be formed.

Indispensably, the total dust emission amount from four color toners of yellow, magenta, cyan and black is less than 16 mg/h, and preferably 14 mg/h or less, more preferably 13 mg/h or less, even more preferably 12 mg/h or less, and is preferably 2.4 mg/h or more, more preferably 2.7 mg/h or more, even more preferably 3.0 mg/h or more.

When the value exceeds the above range, then it would be often difficult to satisfy the Blue Angel Standard depending on the image formation process speed and on the fixation condition. When the value is lower than the range, then the hot offset resistance would be poor and high-quality print images could not be formed.

In the image forming method and the image forming device of the present invention, the gloss value in solid image printing with yellow, magenta and cyan is not specifically defined. From the viewpoint of more remarkably exhibiting the advantageous effects of the present invention, it is desirable that the image forming method and the image forming device of the present invention are used in image formation where the mean gloss value in solid image printing with yellow, magenta cyan is from 22.0 to 60.0.

Specifically, in graphic use in which the amount of the toner to adhere to paper in electrostatic image development thereon is large, both the two of reduction in dust emission amount in fixation and good hot offset resistance can be markedly satisfied.

The method for producing the toner for electrostatic image development (hereinafter this may be abbreviated as "toner for development" or "toner") for use in the present invention is not specifically defined. In a production method for a wet method toner or a grinding method toner, a constitution to be mentioned below may be employed here.

<Constitution of Toner>

The components constituting the toner for use in the present invention include a binder resin, a colorant (pigment) and, in addition thereto and optionally, internal additives such as an electrification-controlling agent, wax and the like, and external additives, etc.

The binder resin includes, for example, a polystyrene resin, an epoxy resin, a polyester resin, a polyamide resin, a styrene-acrylic resin, a styrene-methacrylate resin, a polyurethane resin, a vinyl resin, a polyolefin resin, a styrene-butadiene resin, a phenolic resin, a polyethylene resin, a silicone resin, a butyral resin, a terpene resin, a polyol resin, etc.

Any known colorant may be used in any manner here. Specific examples of the colorant include carbon black, aniline blue, phthalocyanine blue, phthalocyanine green, Hansa yellow, rhodamine pigment, chrome yellow, quinacridone, benzidine yellow, rose Bengal, triallylmethane dye, monoazo pigments, disazo pigments, condensed azo pigments. Any known such dyes and pigments may be used here either singly or as combined.

For the color toners, it is desirable that the yellow toner uses benzidine yellow, monoazo pigments or condensed azo pigments, the magenta toner uses quinacridone or monoazo pigments, and the cyan toner uses phthalocyanine blue. Preferably, the colorant is used in an amount of from 3 parts by mass to 20 parts by mass relative to 100 parts by mass of the polymer primary particles constituting the toner.

An electrification-controlling agent may be used in the toner. Any known electrification-controlling agents may be used here either singly or as combined. The positive-charging electrification-controlling agent includes, for example, quaternary ammonium salts and basic/electron-donating metal substances.

The charging electrification-controlling agent includes, for example, metal chelates, metal salts of organic acids, metal-containing dyes, nigrosine dyes, amide-group containing compounds, phenolic compounds, naphthol compounds and their metal salts, urethane bond-containing compounds, acidic or electron-attractive organic substances.

For use as other toners than black toner in color toners or full-color toners, preferred is a colorless or pale-color electrification-controlling agent not having any color interference with toners.

For example, for the positive-charging electrification-controlling agent, preferred are quaternary ammonium salt compounds. For the negative-charging electrification-controlling agent, for example, preferred are metal salts or metal complexes of salicylic acid or alkylsalicylic acid with chromium, zinc, aluminium or the like, metal salts or metal complexes of benzilic acid, amide compounds, phenol compounds, naphthol compounds, phenolamide compounds, hydroxynaphthalene compounds such as 4,4'-methylenebis[2-[N-(4-chlorophenyl)amide]-3-hydroxynaphthalene], etc.

Preferably, wax is contained in the toner mother particles for use in the present invention. The wax for the toner to be used in the image forming method of the present invention is not specifically defined so far as it satisfies the requirements stated in the claims. Preferably, a suitable type of wax in a suitable amount thereof is selected in consideration of the lamination position of each toner on the recording medium in the fixation step and in such that the dust emission amount falls within the above-mentioned preferred range.

Concretely, preferred are olefinic waxes such as low-molecular-weight polyethylene, low-molecular-weight polypropylene, copolymerized polyethylene, etc.; paraffin wax, Fischer-Tropsch wax; microcrystalline wax; alkyl group-having silicone wax; higher fatty acids such as steric acid, etc.; long-chain aliphatic alcohols such as eicosanol, etc.; long-chain aliphatic group-having ester waxes such as behenyl behenate, montanates, stearyl stearate, etc.; long-chain alkyl group-having ketones such as distearyl ketone, etc.; vegetable waxes such as hydrogenated castor oil, carnauba wax etc.; esters or partial esters to be produced from polyalcohols such as glycerin, pentaerythritol or the like and long-chain fatty acids; higher fatty acid amides such as oleic acid amide, steric acid amide, etc.; low-molecular-weight polyesters, etc.

Of the waxes, preferred are those having a melting point of 30° C. or higher, more preferably 40° C. or higher, even more preferably 50° C. or higher, for improving toner fixation. Also preferred are those having a melting point of 100° C. or lower, more preferably 90° C. or lower, even more preferably 85° C. or lower. Waxes of which the melting point falls within the above range realize excellent fixation capability at low temperatures without causing stickiness.

The above-mentioned waxes may be used either singly or as combined. The amount of the wax is preferably 1 part by mass or more in 100 parts by mass of the toner, more preferably 2 parts by mass or more, even more preferably 5 parts by mass or more. Also preferably, the amount is 40 parts by mass or less, more preferably 35 parts by mass or less, even more preferably 30 parts by mass or less.

When the wax content in the toner is too small, then the high-temperature offset resistance would be poor; but when too large, the anti-blocking performance would be insufficient, and as the case may be, the wax may bleed out of the toner to soil apparatuses or dust emission amount would increase.

Especially preferred wax for satisfying the requirements of the present invention is described. For example, in the toner to be the outermost layer corresponding to the above-mentioned A, preferred is hydrocarbon wax such as paraffin wax, Fischer-Tropsch wax or the like, from the viewpoint of exhibiting releasability. In the toner to be the lowermost layer corresponding to the above-mentioned C, preferred are ester wax and microcrystalline wax.

Regarding the amount thereof, the wax may be in the toner in the amount falling within the above-mentioned range. Preferably, the wax amount in the toner to be the outermost layer corresponding to A is large and the wax amount in the toner to be the lowermost layer corresponding to C is small, as bettering the hot offset resistance of the toner. Concretely, the ratio of the wax amount in the toner to be the outermost layer to the wax amount in the toner to be the lowermost layer is preferably from 1.0 to 3.0.

On the other hand, when the wax amount greatly differs between the toner layers each composed of a different color toner, then the toner layer interface between the different color toners constituting the laminated image would be brittle and the toner may peel away. In a case where such adhesiveness between the toner layers is considered to be important, it is desirable that the wax content in each color toner is the same or different.

Further, it is more desirable that plural different means mentioned above are combined here.

As the external additives, for example, there are mentioned inorganic particles such as silica, aluminium oxide (alumina), zinc oxide, tin oxide, barium titanate, strontium titanate, etc.; organic acid salt particles such as zinc stearate, calcium stearate, etc.; organic resin particles such as methacrylate polymer particles, acrylate polymer particles, styrene-methacrylate copolymer particles, styrene-acrylate copolymer particles, etc.

[Production Method for Toner for Development of Electrostatic Images]

Next described is a production method for the toner for development of electrostatic images in the present invention.

[Production Step for Toner Mother Particles]

The production method for the toner in the present invention is not specifically defined, for which toner mother particles may be produced according to any conventional method of a grinding method, a wet method, or a method of spheronizing toner by mechanical impact force, heat treatment or the like. The wet method includes, for example, a suspension polymerization method, an emulsion polymerization aggregation method, a dissolution suspension method, an ester extension method, etc.

<Grinding Method>

A method for producing toner mother particles according to a grinding method is described. In a case of a grinding method, a binder resin and a colorant and optionally any other components are weighed each in a predetermined amount and blended, and mixed. The mixing device includes, for example, a double cone mixer, a V-shaped mixer, a drum-shaped mixer, a super-mixer, a Henschel mixer, a Nauta mixer, etc.

Next, the toner material thus prepared by formulating and mixing the components is melt-kneaded to dissolve the resin and others, in which the colorant and others are dispersed. In the melt-kneading step, for example, usable is a batch-type kneading machine such as a pressure kneader, a Banbury mixer or the like, or a continuous kneading machine.

As the kneading machine, usable here is a single-screw or double-screw extruder. For example, there are mentioned KTK Model double-screw extruder by Kobe Steel, TEM Model double-screw extruder by Toshiba Machine, double-screw extruder by KCK, co-kneader by Buss, etc. Further, the color resin composition prepared by melt-kneading the toner material may be, after melt-kneaded, rolled with a two-roll mill or the like and then cooled in a cooling step of cooling it with water or the like.

The cooled product of the color resin composition prepared in the above is then ground to have a desired grain size in a grinding step. In the grinding step, first, the composition is roughly ground with a crusher, a hammer mill, a feather mill or the like, and then further ground in a Cryptron system by Kawasaki Heavy Industries, a super rotor by Nisshin Engineering, etc.

Subsequently, if desired, the resultant powder is classified using a screening machine, for example, a classification apparatus such as an inertia classification elbow jet (by Nittetsu Mining), a centrifugal classification Turboprex (by Hosokawa Micron) or the like to give toner mother particles. Further, the toner may be spheronized according to a conventional method.

<Wet Method>

In the invention, a wet method is preferably employed for producing toner mother particles in a wet-method medium. The wet method includes a suspension polymerization method, an emulsion polymerization aggregation method, a dissolution suspension method, etc., and any method is employable herein for the production with no specific limitation. Preferred are those produced according to an emulsion polymerization aggregation method.

(Suspension Polymerization Method)

In a suspension polymerization method, a colorant and a polymerization initiator, and optional additives such as a wax, a polar resin, a charge controlling agent and a crosslinking agent are dissolved or dispersed in a monomer of a binder resin to prepare a monomer composition. The monomer composition is dispersed in a water-based medium containing a dispersion stabilizer, etc.

The resultant composition is granulated while the stirring speed and the time are controlled so that the liquid droplets of the monomer composition could have a size of desired toner particles. Subsequently, the particulate state is kept as such owing to the action of the dispersion stabilizer, and this is stirred in such a degree that the particles could be prevented from precipitating, and the monomer is thus polymerized. This is washed and filtered to collect the toner mother particles.

(Dissolution Suspension Method)

In a dissolution suspension method, a binder resin is dissolved in an organic solvent and a colorant and others are added to and dispersed therein to give a solution phase. This is dispersed in an aqueous phase containing a dispersant or the like, by mechanical shear force to form liquid droplets, and the organic solvent is removed from the liquid droplets to give the toner mother particles.

(Emulsion Polymerization Aggregation Method)

An emulsion polymerization aggregation method includes an aggregation step of preparing polymer primary particles of a binder resin monomer formed in an emulsion polymerization step, a colorant dispersion, a wax dispersion others, and then dispersing and heating them in a water-based medium, followed by a ripening step.

This is washed and filtered to collect the toner mother particles. Next, the toner mother particles are treated in a drying step. Further, if desired, external additives are added to the toner mother particles to produce the toner.

The emulsion polymerization aggregation method is described in more detail. In the emulsion polymerization step, in general, a polymerizing monomer to be a binder resin is polymerized in a water-based medium in the presence of an emulsifier, and in this step, in supplying the polymerizing monomers in the reaction step, each monomer may be separately added thereto, or plural types of monomers may be previously mixed so as to be added thereto all at a time. The monomer may be added directly as it is, or may be previously mixed with water, an emulsifier and the like to prepare an emulsion, and the resultant emulsion may be added.

An acid monomer usable here includes, for example, carboxyl group-having polymerizing monomers such as acrylic acid, methacrylic acid, maleic acid, fumaric acid, cinnamic acid, etc.; sulfonic acid group-having polymerizing monomers such as sulfonated styrene, etc., sulfonamide group-having polymerizing monomer such as vinylbenzenesulfonamide, etc.

A basic monomer also usable here includes, for example, amino group-having aromatic vinyl compounds such as aminostyrene, etc.; nitrogen-containing heterocyclic polymerizing monomers such as vinylpyridine, vinylpyrrolidone, etc.; amino group-having (meth)acrylates such as dimethylaminoethyl acrylate, diethylaminoethyl methacrylate, etc.

One alone or two or more of these acid monomers and basic monomers may be used here either singly or as combined. The monomers may exist as salts accompanied by a counter ion. Above all, preferred is use of acid monomers, and more preferred are acrylic acid and/or methacrylic acid.

The total amount of the acid monomer and the basic monomer in 100% by mass of all the polymerizing monomers constituting the binder resin is preferably 0.05% by mass or more, more preferably 0.5% by mass or more, even more preferably 1% by mass or more, and is preferably 10% by mas or less, more preferably 5% by mass or less.

Other polymerizing monomers usable here include, for example, styrenes such as styrene, methylstyrene, chlorostyrene, dichlorostyrene, p-tert-butylstyrene, p-n-butylstyrene, p-n-nonylstyrene, etc.; acrylates such as methyl acrylate, ethyl acrylate, propyl acrylate, n-butyl acrylate, isobutyl acrylate, hydroxyethyl acrylate, 2-ethylhexyl acrylate, etc.; methacrylates such as methyl methacrylate, ethyl methacrylate, propyl methacrylate, n-butyl methacrylate, isobutyl methacrylate, hydroxyethyl methacrylate, 2-ethylhexyl methacrylate, etc.; acrylamide, N-propylacrylamide, N,N-dimethylacrylamide, N,N-dipropylacrylamide, N,N-dibutylacrylamide, etc. One alone or two or more polymerizing monomers may be used here either singly or as combined.

The toner for development of electrostatic images in the present invention contains, as the binder resin therein, a homopolymer of a single monomer of styrenes, or a styrenic resin of a polymer comprising a monomer of styrenes and any other monomer. According to the present invention, even when a styrenic resin is contained as the binder resin, the concentration of the volatile organic compound to be contained in the toner can be reduced so that the value calculated by dividing the styrene concentration, as measured according to the method in the present invention, by the ethylbenzene concentration could be 5 or less.

For example, the value calculated by dividing the styrene concentration by the ethylbenzene concentration in a commercially-available toner, as measured according to the method in the present invention, is 15 or more, and according to the method in the present invention, the content of the volatile organic compound such as styrene or the like can be reduced even when a styrenic resin is used as the binder resin.

Further, in a case where the binder resin is a crosslinked resin, used is a polyfunctional monomer having a radical-polymerizing group along with the above-mentioned polymerizing monomer. For example, there are mentioned divinylbenzene, hexanediol diacrylate, ethylene glycol dimethacrylate, diethylene glycol dimethacrylate, diethylene glycol diacrylate, triethylene glycol diacrylate, neopentyl glycol dimethacrylate, neopentyl glycol acrylate, diallyl phthalate, etc. Also usable is a polymerizing monomer having a reactive group in the pendant group, for example, glycidyl methacrylate, methylolacrylamide, acrolein, etc. Above all, preferred is a radical-polymerizing difunctional monomer, and especially preferred are divinylbenzene and hexanediol diacrylate. One alone or two or more different types of these polyfunctional polymerizing monomers may be used here either singly or as combined.

In case where the binder resin is prepared through emulsion polymerization, usable is any known surfactant as an emulsifier. One or more surfactants selected from cationic surfactants, anionic surfactants and nonionic surfactants are usable either singly or as combined.

The cationic surfactants include, for example, dodecylammonium chloride, dodecylammonium bromide, dodecyltrimethylammonium bromide, dodecylpyridinium chloride, dodecylpyridinium bromide, hexadecyltrimethylammonium bromide, etc.

The anionic surfactants include, for example, fatty acid soaps such as sodium stearate, potassium dodecanoate, etc., sodium dodecylsulfate, sodium dodecylbenzenesulfonate, sodium laurylsulfate, etc.

The nonionic surfactants include, for example, polyoxyethylene dodecyl ether, polyoxyethylene hexadecyl ether, polyoxyethylene nonylphenyl ether, polyoxyethylene lauryl ether, polyoxyethylene sorbitan monooleate ether, monodecanoylsucrose, etc.

The amount of the emulsifier to be used is generally from 0.1 parts by mass to 10 parts by mass relative to 100 parts by mass of the polymerizing monomer. Along with the emulsifier, also usable here are one or more of polyvinyl alcohols such as partially or completely saponified polyvinyl alcohol, etc., cellulose derivatives such as hydroxyethyl cellulose and others, as a protective colloid.

The volume-average particle size of the polymer primary particles obtained through emulsion polymerization is preferably 0.02 μm or more, more preferably 0.05 μm or more, even more preferably 0.1 μm or more, and is preferably 3 μm or less, more preferably 2 μm or less, even more preferably 1 μm or less. When the particle size is too small, the aggregation speed would be difficult to control in the aggregation step; but when too large, then the size of the toner particles to be produced through aggregation would be easy to increase and a toner having the intended particle size would be difficult to produce.

If desired, any known polymerization initiator may be used in the emulsion polymerization aggregation method. One or two different types of polymerization initiators are usable either singly or as combined. For example, usable are persulfates such as potassium persulfate, sodium persulfate, ammonium persulfate, etc.; and redox initiators comprising a combination of any of such persulfates as one component along with a reducing agent such as acidic sodium sulfite or the like; water-soluble polymerization initiators such as hydrogen peroxide, 4,4'-azobiscyanovaleric acid, t-butyl hydroperoxide, cumene hydroperoxide, etc.; and redox initiators comprising any of these water-soluble polymerization initiators as one component along with a reducing agent such as a ferrous salt or the like; benzoyl peroxide, 2,2'-azobisisobutyronitrile, etc.

The polymerization initiator may be added to the polymerization system in any stage before, along with or after monomer addition, and if desired, the addition modes may be combined.

If desired, any known chain transfer agent is usable here. Specific examples of the chain transfer agent include t-dodecylmercaptan, 2-mercaptoethanol, diisopropyl xanthogenate, carbon tetrachloride, trichlorobromomethane, etc. One alone or two or more chain transfer agents may be used here either singly or as combined, and the amount thereof may be from 0 to 5% by mass relative to the polymerizing monomer.

Also if desired, any known suspension stabilizer is usable. Specific examples of the suspension stabilizer include calcium phosphate, magnesium phosphate, calcium hydroxide, magnesium hydroxide, etc. One alone or two or more of these may be used either singly or as combined, and the amount thereof may be from 1 part by mass to 10 parts by mass relative to 100 parts by mass of the polymerizing monomer.

The polymerization initiator and the suspension stabilizer may be added to the polymerization system in any stage before, along with or after addition of the polymerizing monomer thereto, and if desired, the addition modes may be combined.

In addition, a pH regulator, a polymerization degree regulator, a defoaming agent and the like may be suitably added to the polymerization system.

In the emulsion polymerization aggregation method, the colorant is added to the system generally in the aggregation step. A dispersion of polymer primary particles and a dispersion of colorant particles are mixed to prepare a mixed dispersion, and this is aggregated to give particulate aggregates.

Preferably, the colorant is dispersed in water in the presence of an emulsifier. The volume-average particle size of the colorant particles is preferably 0.01 μm or more, more preferably 0.05 μm or more, and is preferably 3 μm or less, more preferably 1 μm or less.

In a case where a charge-controlling agent is contained in the toner according to the emulsion polymerization aggregation method, the charge-controlling agent may be added along with a polymerizing monomer and others during emulsion polymerization, or added along with polymer primary particles and a colorant and others in the aggregation step, or added after the polymer primary particles and the colorant and others have been aggregated to form particles having an almost intended particle size.

Of those methods, preferred is the method where a charge-controlling agent is dispersed in water along with a surfactant to prepare a dispersion having a volume-average particle size of from 0.01 μm to 3 μm and then the dispersion is added in the aggregation step.

The aggregation step in the emulsion polymerization aggregation method is carried out in a tank equipped with a stirring unit. For the step, employable is any of a heating method, a method of adding an electrolyte, or a combined method of these. In a case where polymer primary particles are aggregated with stirring to give particulate aggregates having nearly the intended particle size, the particle size of the aggregated particles may be controlled by the balance between the cohesion force of the particles and the shear force by stirring; however, by heating or by adding an electrolyte, the cohesion force can be enlarged.

In case where an electrolyte is added for aggregation, any of organic salts and inorganic salts are usable as the electrolyte. Concretely, the electrolytes include, for example, NaCl, KCl, LiCl, $Na_2SO_4$, $K_2SO_4$, $Li_2SO_4$, $MgCl_2$, $CaCl_2$, $MgSO_4$, $CaSO_4$, $ZnSO_4$, $Al_2(SO_4)_3$, $Fe_2(SO_4)_3$, $CH_3COONa$, $C_6H_5SO_3Na$, etc. Of those, preferred are inorganic salts having a divalent or more polyvalent metal cation.

The amount of the electrolyte to be added varies depending on the type of the electrolyte and the intended particle size. In general, the amount is from 0.05 parts by mass or more, relative to 100 parts by mass of the solid component in the mixed dispersion, more preferably 0.1 parts by mass or more. Also preferably, the amount is 25 parts by mass or less, more preferably 15 parts by mass or less, even more preferably 10 parts by mass or less.

When the added amount falls within the above range, then the aggregation reaction would go on rapidly, and therefore after aggregation reaction, fine powder or amorphous matter would not form and the particle size can be relatively easily controlled, and particulate aggregates having an intended mean particle size can be thereby obtained. The aggregation temperature at which aggregation is carried out through electrolyte addition is preferably 20° C. or higher, more preferably 30° C. or higher, and is preferably 70° C. or lower, more preferably 60° C. or lower.

The aggregation temperature in a case where aggregation is carried out merely by heating without using an electrolyte is preferably (Tg−20)° C. or higher, where Tg means the glass transition temperature of the polymer primary particles, more preferably (Tg−10)° C. or higher. Also preferably, the temperature is Tg or lower, more preferably (Tg−5)° C. or lower.

The time to be taken for aggregation is optimized depending on the apparatus configuration and the process scale. In order that the particle size of the toner could reach the intended level, it is desirable that the system is kept at the above-mentioned, predetermined temperature generally for at least 30 minutes or more. Heating until the system could reach the predetermined temperature may be carried out at a constant speed, or the system may be stepwise heated.

If desired, resin particles may be adhered to or may be firmly fixed on the surface of the particulate aggregates after the aggregation treatment. By adhering or firmly fixing properties-controlled resin particles onto the surface of the particulate aggregates, the electrification characteristic and the heat resistance of the resultant toner could be improved, and further, the advantageous effects of the present invention could be thereby made to be more remarkable.

In the case, use of resin particles of which the glass transition temperature is higher than the glass transition temperature of the polymer primary particles is favorable as capable of realizing further more improvement of the antiblocking properties of the resultant toner without detracting from the fixation capability thereof.

The volume-average particle size of the resin particles is preferably 0.02 μm or more, more preferably 0.05 μm or more, and is preferably 3 μm or less, more preferably 1.5 μm or less. As the resin particles, usable here are those prepared through emulsion polymerization of the same monomer as the polymerizing monomer for use for the above-mentioned polymer primary particles.

In general, the resin particles are dispersed in water or a liquid mainly comprising water along with a surfactant therein to prepare a dispersion for use herein. In a case where an electrification-controlling agent is added after the aggregation treatment, it is desirable that the electrification-controlling agent is first added to the dispersion containing particulate aggregates and then the resin particles are added thereto. For increasing the stability of the particulate aggregates formed in the aggregation step, it is desirable that the particulate aggregates are ripened for intragranular fusion of the particles in a ripening step after the aggregation step.

The temperature in the ripening step after the aggregation step in the emulsion polymerization aggregation method is not lower than Tg of the polymer primary particles, more preferably not lower than a temperature higher by 5° C. than Tg, and is preferably not higher than a temperature higher by 80° C. than Tg, more preferably not higher than a temperature higher by 50° C. than Tg. The time to be taken in the ripening step may vary depending on the shape of the intended toner. After having reached the glass transition temperature of the polymer primary particles or higher, the system is kept as such preferably for from 0.1 to 10 hours, more preferably for from 1 to 6 hours.

After the aggregation step but preferably before the ripening step or during the ripening step, it is desirable that a surfactant is added or the pH value of the system is increased. For the surfactant to be used here, one or more may be selected from the emulsifiers for use in production of the polymer primary particles. Especially preferably, the same emulsifier as that used in producing the polymer primary particles is used.

In case where a surfactant is added, the amount thereof is not specifically defined. Preferably, the amount is 0.1 parts by mass or more relative to 100 parts by mass of the solid component in the mixed dispersion, more preferably 1 part by mass or more, even more preferably 3 parts by mass or more, and is preferably 20 parts by mass or less, more preferably 15 parts by mass or less, even more preferably 10 parts by mass or less.

By adding a surfactant or by increasing the pH value after the aggregation step and before completion of the ripening step, the particulate aggregates formed in the aggregation step can be prevented from further aggregating, and therefore any coarse particles can be prevented from forming after the ripening step.

Through the heat treatment in the ripening step, the polymer primary particles of the aggregates can be fused and integrated so that the toner particles of the aggregates can be nearly spheronized. It is considered that the particulate aggregates before the ripening step would be aggregates formed through electrostatic or physical aggregation of the polymer primary particles, but after the ripening step, the polymer primary particles to constitute the particulate aggregates fuse together and the shape of the toner mother particles can be thereby nearly spherical.

Through the ripening step in which the temperature and the necessary time may be controlled, the polymer primary particles could be further aggregated or could be further more fused to be spherical, thereby giving toner mother particles having different shapes depending on the intended use thereof.

[Washing Step for Toner Mother Particles]

The toner mother particles produced according to a wet method, such as a suspension polymerization method, an emulsion polymerization aggregation method, a dissolution suspension method or the like, are separated from the wet-method medium through solid-liquid separation, and the toner mother particles are thus collected as particulate aggregates, and if desired, it is desirable to wash them.

The liquid to be used for washing may be water having a higher purity than that of the wet-method medium in which the toner is dipped in the final step of the wet method, or may also be an aqueous solution of acid or alkali. The acid includes, for example, inorganic acids such as nitric acid, hydrochloric acid, sulfuric acid, etc.; and organic acids such as citric acid, etc. The alkali includes, for example, sodium salts (sodium hydroxide, sodium carbonate, etc.), silicates (sodium metasilicate, etc.), phosphates, etc. The washing may be carried out at room temperature or by heating at from 30 to 70° C. or so.

In the washing step, the suspension stabilizer, the emulsifier, the wet-method medium, the unreacted remaining monomer, small-size toner particles and the like are removed from the toner mother particles. After the washing step, it is desirable that the toner mother particles are collected as wet cake through filtration or decantation. This is because the form of wet cake is easy to handle in the subsequent step. The washing step may be repeated a few times or more.

[Step of Removing Water from Toner Mother Particles]

The production method for the toner for development of electrostatic images in the present invention preferably includes a step of removing water from the toner mother particles to be in an amount of 0.4% by mass or less, before the drying step to be mentioned below. The toner mother particles in the form of wet cake after the washing step is in a wet state, and therefore the water content of the toner mother particles is preferably 50% by mass or less relative to 100% by mass of the toner mother particles, more preferably 40% by mass or less, even more preferably 30% by mass or less.

From the toner mother particles in such a wet state, water is previously evaporated away so that the water content of the particles could be 0.4% by mass or less, and as a result, in the following drying step, the volatile organic compounds contained in the toner mother particles can be efficiently diffused out.

The drying machine to be used in the water removing step includes, for example, a fluidized drier, a jet drier, a reduced-pressure drier, etc. Preferred is used of a fluidized drier, in which a vapor is introduced for drying so that the evaporation latent heat of water is directly given to the toner mother particles to accelerate the water removing speed.

For example, usable is a fluidized drier equipped with a shaking unit as described below, or also usable is a fluidized drier not equipped with a shaking unit. More preferred is use of a fluidized drier not equipped with a shaking unit.

Regarding the vapor, the vapor temperature and the drier temperature to be applied to the fluidized drier for use in the water removing step, the same vapor and condition as those for the vapor, the vapor temperature and the drier temperature to be applied to the shaking unit-equipped fluidized drier for use in the drying step to be mentioned below are applicable thereto.

[Step of Drying Toner Mother Particles]

In the step of drying the toner mother particles, usable is a drying machine such as a fluidized drier, a jet drier, a reduced drier, etc. Above all, preferred is drying with a fluidized drier equipped with a shaking unit. In the fluidized drier equipped with a shaking unit, a vapor stream is introduced into the drier body and, using the latent heat of the moisture contained in the toner mother particles, the toner mother particles can be rapidly dried.

By the shaking unit, the toner mother particles can be shaken, and therefore, even though the vapor flow rate is reduced, the toner mother particles can be fluidized, and the aggregates gathering at the bottom may be ground and the toner mother particles can be thereby rapidly and efficiently dried.

Preferably, the drying is carried out under ordinary pressure or under reduced pressure. Under reduced pressure, the quantity of heat that the vapor can give to the toner particles is small, and therefore, it is more desirable that the drying is carried out under normal pressure.

[Toner Forming Step]

Next, external additives are added to the toner mother particles so that the external additives are adhered to or firmly fixed on the surface of the toner mother particles, thereby forming a toner. Adding external additives improves OPC (organic photoconductor) filming resistance and transfer efficiency.

As the method of adding external additives to the toner mother particles, employable here is a method of adding external additives to the system where the toner mother particles have been put, and stirring and mixing them. For stirring and mixing the toner mother particles and external additives, preferably used is a mechanical rotation treatment apparatus, and concretely used is a rotation-type mixing machine such as a Henschel mixer.

The speed of the tip part (peripheral speed) of the stirring blade, the stirring speed in the addition treatment using the apparatus is preferably from 21.2 to 95.5 m/sec, more preferably from 38.2 to 76.4 m/sec. By controlling the rotation speed, it is possible to control the burying degree of the color particles of the external additive in the stirring and mixing treatment, and as a result, the flowability of the resultant toner can be thereby controlled.

Preferably, the toner in the present invention is so configured that the external additives are uniformly adhered to the surfaces of the toner particles. In a case where a plurality of particles each having a different particle size (hereinafter referred to as "particles of different particle sizes") are used as the external additives, the respective external additives may be mixed in two or more stages, whereby the external additives may be uniformly adhered to the surfaces of the toner particles. Preferably employed is a multistage mixing method where small-size external additives are first added and mixed, and then large-size external additives are added and mixed.

The stirring time to be taken for the stirring and mixing treatment may be determined in accordance with the stirring speed, etc.

The temperature at which the external additives are added is preferably from 25° C. to 55° C., more preferably from 30 to 50° C.

[Physical Properties of Toner]

The mean circularity of the toner to be produced according to the method in the present invention is preferably 0.955 or more, more preferably 0.960 or more. Also preferably, the circularity is 0.985 or less, more preferably 0.980 or less. When the mean circularity degree of the toner falls within the range, then good images can be formed.

EXAMPLES

The invention is described more concretely with reference to the following Examples; however, not overstepping the spirit and the scope thereof, the invention is not limited to the following Examples. In the following Examples, "part" is "part by weight".

The particle size, the circularity and the electric conductivity were measured as follows.

<Measurement of Volume-Average Diameter (MV)>

The volume-average diameter (MV) of particles having a volume-average diameter (MV) of less than 1 micron was measured, using Nikkiso's Model, Microtrac Nanotrac 150 (hereinafter abbreviated as "Nanotrac") and using the same company's analysis software Microtrac Particle Analyzer Ver. 10. 1.2.-019EE. The sample was analyzed according to the method described in the instruction manual and using ion-exchanged water having an electric conductivity of 0.5 μS/cm as a solvent, in which the solvent refractivity was 1.333, the measurement time was 600 seconds, the measurement time was 1 time. Regarding the other present conditions, the particle refractivity was 1.59, the particles were transparent and spherical, and had a density of 1.04.

<Volume Median Diameter of Wax Dispersion>

For determining the end point in wax emulsification, used was a high-speed operable laser diffraction scattering particle sizer, Horiba Seisakusho's Partica LA-950V2 (hereinafter abbreviated as LA950). The end point particle size in this was set as a median diameter. As the solvent, used was ion-exchanged water having an electric conductivity of 0.5 μS/cm. The solvent refractivity was 1.333, and the sample amount was controlled in a concentration range giving a visible light transmittance of from 70% to 90%.

<Measurement Method and Definition of Median Diameter (Volume: Dv50, and Number: Dn50)>

After the external additive addition step, the finally obtained toner was pretreated before measurement, in the manner as follows. Using a spatula, 0.100 g of the sample was put into a cylindrical polyethylene(PE) beaker having an inner diameter of 47 mm and a height of 51 mm. Using a dropper, 0.15 g of an aqueous solution of 20 mass % DBS (Neogen S-20A available from Daiichi Kogyo Seiyaku) was added thereto.

In this step, the toner and the aqueous 20% DBS solution were put into only the bottom of the beaker so that the toner would not scatter around the edge of the beaker. Next, using a spatula, this was stirred for 3 minutes until the toner and the aqueous 20% DBS solution could be pasty. In this step, attention was paid so that the toner would not scatter around the edge of the beaker.

Subsequently, 30 g of a dispersant Isoton II was added thereto, and stirred for 2 minutes with a spatula to give a solution visually uniform as a whole. Next, a fluororesin-coated rotator having a length of 31 mm and a diameter of 6 mm was put into the beaker, and using a stirrer, this was dispersed at 400 rpm for 20 minutes.

In this step, using a spatula at a rate of once per 3 minutes, microscopic particles observed in the vapor-liquid interface and at the edge of the beaker were dropped down into the beaker to form a uniform dispersion. Subsequently, this was filtered through a mesh having an opening of 63 μm, and the resultant filtrate was referred to as "toner dispersion".

For measurement of the particle size of the toner mother particles during the production step, the slurry being aggregated was filtered through a 63-μm mesh to give a filtrate "slurry liquid".

The median diameter (Dv50 and Dn50) of the particles was measured using Beckman Coulter's Multisizer III (having an aperture diameter of 100 μm) (hereinafter abbreviated as "Multisizer") and using the same company's Isoton II as the dispersion medium. The above-mentioned "toner dispersion" or the "slurry liquid" was diluted to have a dispersoid concentration of 0.03% by mass, and using Multisizer III analysis software, the sample was analyzed, in which the KD value was 118.5.

The particle size measurement range was from 2.00 to 64.00 μm, and this range was discretized into 256 divisions at regular intervals on the logarithmic scale. The value calculated from the volume-based statistics was defined as the volume median diameter (Dv50). The value calculated from the number-based statistics was defined as the number median diameter (Dn50).

<Measurement Method and Definition of Mean Circularity>

In the present invention, the "mean circularity" was measured as follows, and defined as follows. Concretely, the toner mother particles were dispersed in a dispersion medium (Isoton II, by Beckman Coulter) to be in a range of from 5720 to 7140 particles/μL. Using a flow particle image analyzer (Sysmex's FPIA 3000), the sample was analyzed under the instrument condition mentioned below, and the value was defined as "mean circularity". In the present invention, the same measurement was repeated three times, and the arithmetic average of the three "mean circularity" data was employed as the "mean circularity" of the analyzed sample.

Mode: HPF

Amount for HPF analysis: 0.35 μL

Number of HPF detection particles: 8,000 to 10,000

The following is one measured in the above-mentioned instrument and automatically calculated therein and expressed. [Circularity] is defined by the following formula.

[Circularity]=[peripheral length of circle having the same area as the particle projected area]/[peripheral length of particle projected image]

From 8,000 to 10,000 particles that are the number of HPF detection particles were measured, and the arithmetic average of the circularity of each particle is displayed on the instrument as "mean circularity".

<Measurement of Electric Conductivity>

The electric conductivity was measured using an electric conductivity meter unit (Yokokawa Electric's Personal SC Meter Model SC72 and Detector SC72SN-11).

<Method for Measurement of Weight-Average Molecular Weight and Molecular Weight Peak>

Measured through gel permeation chromatography (GPC). (Apparatus: Tosoh's GPC HLC-8020, Column: Polymer Laboratory's PL-gel Mixed-B 10μ, Solvent: tetrahydrofuran, Sample Concentration: 0.1 wt %, Calibration Curve: standard polystyrene).

<Dust Emission Amount (Emission Rate)>

All four cartridges of a color page printer ML 9600PS (by Oki Data) were filled with the toner for development, and the dust was collected according to the measurement method certified by the Blue Angel Mark (RAL_UZ122__2006), and from the mass measurement of the substance collected on the filter, the dust emission rate was determined.

Concretely, the emission test chamber (VOC-010/volume 1000 L/by Espec) was previously baked. After blank measurement, the above-mentioned printer and the dust counting filter were set, and the system was kept stand-by for 60 minutes until the temperature and the humidity in the tank could reach the rated values (23±2° C./50±5%).

The printer was driven by remote operation and at the same time suction through the filter was started. After a prescribed number of sheets were printed and for further 2 hours, the suction collection was continued. The print pattern used here is VE110-7, Version 2006-06-01 (RAL_UZ122/RALC00, PDF).

The dust emission rate was calculated according to the following formulae.

(1) Dust Mass after Temperature Humidity Correction $$m_{Si}=(m_{MF\ brutto}-m_{MF\ tara})+(m_{RF1}-m_{RF2})$$

$m_{MF\ tara}$: weight of mass-stabilized measurement filter before dust sample collection (mg)

$m_{MF\ brutto}$: weight of mass-stabilized measurement filter after dust sample collection (mg)

$m_{RF1}$: weight of standard filter before test (mg)

$m_{RF2}$: weight of standard filter after test (mg)

(2) Dust Emission Rate (Dust Emission Amount)

$$EF_{uSi}=(m_{Si}\times n\times V\times t_0)/(V_s\times t_o)$$

n: ventilation frequency ($h^{-1}$)

$t_o$: total sampling time (min)

$t_p$: printing time (min)

V: chamber volume ($m^3$)

$V_s$: volume of air sucked after having passed through filter ($m^3$)

The lower limit of the dust emission amount was set as 0.6 mg/h from the reliability of weight measurement, and a case lower than the limit value was read as 0.6.

In carrying out the measurement, when the amount of the toner to be printed is extremely too large or extremely too small, or when correct measurement would be difficult owing to imaging failure such as extreme fogging, rubbing, white staining or the like, the cartridge members and others were exchanged or adjusted within a range not having any influence on the measurement results, and then the measurement was carried out.

Concretely, for example, there are mentioned change of developing rollers, adjustment of charging blade contact pressure, adjustment of process bias, etc. The toner adhering amount is not specifically defined so far as the amount could be one capable of realizing an ordinary image density. Preferably, the amount is an ordinary level of from 0.3 to 0.6 $mg/cm^2$ or so for the measurement.

In the following Examples and Comparative Examples, the toner adhering amount in the measurement was from 0.45 to 0.55 $mg/cm^2$.

<Evaluation of Hot Offset (HOS) Resistance>

The cyan, magenta, yellow and black color toners for development were charged in the corresponding cartridges of a color page printer ML 9600PS (by Oki data) and set in the printer. In an environment at a temperature of 28° C. and a humidity of 80%, 500 sheets of white paper were printed so that the printer was well warmed up.

Immediately after this, three sheets were printed each with a full-solid color image in which three color toners of cyan toner, magenta toner and yellow toner, are laminated on a printing paper, using Excellent White A4 (by Oki Data) and the resultant images were visually checked for the hot offset resistance and evaluated as follows.

O: No problem at all.

OΔ: Only slight peeling failure was seen with no problem.

x: Peeling failure was remarkable, and no good.

xx: Serious peeling failure was remarkable, and no good.

In this printer, in general, toners of cyan, magenta, yellow and black are laminated in that order from the first layer on the printing paper just before the fixation step, but by changing the toner setting position, this order may be changed in any desired manner for evaluation.

<Gloss Value>

The gloss value is measured on the image printed by setting the toner for measurement in an image forming device for measurement. Concretely, a monochromatic solid image was printed with the image forming device for measurement, the printed paper was then set in a predetermined measurement site in a gloss meter (Nippon Denshoku Kogyo's VG2000). The projecting and receiving angle was set at 75°, and three points at both sides and the center of the image were measured and the measured values were averaged to give a mean value referred to as a gloss value. As the printing paper, used was Excellent White A4 (by Oki Data).

Here, the "image forming device for measurement" is not limited to a specific image forming device, but may indicate any image forming device capable of printing images with the "toner for measurement".

<Preparation of Black Colorant Dispersion>

20 parts of carbon black produced according to a furnace process, of which the toluene extract has a UV absorbance of 0.02 and which has a true density of 1.8 $g/cm^3$, (by Mitsubishi Chemical, Mitsubishi carbon black MA100S), 1 part of anionic surfactant (by Daiichi Kogyo Seiyaku, Neogen S-20D), 4 parts of nonionic surfactant (by Kao, Emulgen 120), and 75 parts of ion-exchanged water having conductivity of 1 μS/cm were put in the chamber of a stirrer equipped with a propeller, and preliminarily dispersed therein to give a pigment premix liquid.

After premixed, the volume cumulative 50% diameter Dv50 of the carbon black in the dispersion was about 90 μm. The premix liquid was used as a starting slurry, and fed into a wet bead mill and dispersed therein in one-pass operation. The inner diameter of the stator was 120 mmϕ, the diameter of the separator was 60 mmϕ, and the diameter of the zirconia beads (true density 6.0 $g/cm^3$) used as dispersion media was 50 μm. The effective internal volume of the stator was about 2 liters, the volume filled with the media was 1.4 liters, and therefore the media-filling rate was 70%.

The rotation speed of the rotor was set constant (the peripheral speed of the rotor tip was about 11 m/sec), and the above-mentioned premix slurry was fed through the supply port via a non-pulsatile metering pump at a supply rate of about 40 liter/hr, and at the time when the particles reached a predetermined particle size, the product was taken out of the discharge port. During the operation, cooling water at about 10° C. was circulated through the jacket, and a black colorant dispersion was thus produced.

<Preparation of Wax Dispersion A1>

26.7 parts of wax 1 [HiMic-1090 (by Nippon Seiro)], 3.0 parts of pentaerythritol tetrastearate (acid value 3.0, hydroxyl value 1.0), 0.3 parts of decaglycerin decabehenate (acid value 3.2, hydroxyl value 27), 2.8 parts of aqueous 20% sodium dodecylbenzenesulfonate solution (Daiichi Kogyo Seiyaku's Neogen S20D, hereinafter abbreviated as aqueous 20% DBS solution) and 67.3 parts of desalted water were put into a reactor and heated at 100° C., and processed for primary circulation emulsification under a pressure condition at 10 MPa, using a homogenizer equipped with a pressure circulation line (Gaulin's LAB60-10TBS Model).

Using LA950, the particle size was measured at intervals of a few minutes, and immediately after the median diameter lowered to around 500 nm, the pressure condition was increased up to 25 MPa, and the system was further processed for secondary circulation emulsification. This was dispersed until the median diameter lowered to 230 nm or less to prepare a wax dispersion A1. The volume median diameter of the wax dispersion was 215 nm.

<Preparation of Wax Dispersion A2>

A wax dispersion A2 was produced in the same manner as that for the wax dispersion A1 except that the wax 1 was changed to wax 2 (HNP-9 (by Nippon Seiro)). The volume median diameter of the wax dispersion was 219 nm.

<Preparation of Wax Dispersion A3>

A wax dispersion A3 was produced in the same manner as that for the wax dispersion A1 except that the wax 1 was changed to wax 3 (HNP-51 (by Nippon Seiro)). The volume median diameter of the wax dispersion was 216 nm.

<Preparation of Wax Dispersion A3>

A wax dispersion A4 was produced in the same manner as that for the wax dispersion A1 except that 30.0 parts of wax 4 (carnauba wax (melting point: 88° C.)), 2.8 parts of aqueous 20% DBS solution and 67.3 parts of desalted water were used. The volume median diameter of the wax dispersion was 267 nm.

<Preparation of Wax Dispersion A5>

A wax dispersion A5 was produced in the same manner as that for the wax dispersion A4 except that the wax 4 was changed to wax 5 (WEP-4 (by NOF)). The volume median diameter of the wax dispersion was 257 nm.

<Preparation of Polymer Primary Particles Dispersion B1>

36.3 parts of the wax dispersion A1 and 218 parts of desalted water were put into a reactor equipped with a stirrer (three impellers), a heating and cooling unit, a condenser and a starting material/auxiliary agent feeder, and heated up to 90° C. in a nitrogen stream atmosphere with stirring.

Subsequently, while the liquid was kept stirred, a mixture of "polymerizing monomers, etc." and "aqueous emulsifier solution" mentioned below was added thereto, taking 5 hours. The time at which adding the mixture was started is referred to as "polymerization start". In 30 minutes after the polymerization start, the following "aqueous initiator solution" was added to the system, taking 4.5 hours, and further in 5 hours after the polymerization start, the following "additional aqueous initiator solution" was added thereto, taking 2 hours. While further kept stirred, the system was kept as such at an internal temperature of 90° C. for 1 hour.

| [Polymerizing Monomers, etc.] | |
|---|---|
| Styrene | 76.8 parts |
| Butyl acrylate | 23.2 parts |
| Acrylic acid | 1.5 parts |
| Hexanediol diacrylate | 0.7 parts |
| Trichlorobromomethane | 1.0 part |

| [Aqueous Emulsifier Solution] | |
|---|---|
| Aqueous 20% DBS solution | 1.0 part |
| Desalted water | 67.1 parts |

| [Aqueous Initiator Solution] | |
|---|---|
| Aqueous 8 mass % hydrogen peroxide solution | 15.5 parts |
| Aqueous 8 mass % L(+)-ascorbic acid solution | 15.5 parts |

| [Additional Aqueous Initiator Solution] | |
|---|---|
| Aqueous 8 mass % L(+)-ascorbic acid solution | 14.2 parts |

After the polymerization reaction, the system was cooled to give a milky polymer primary particles dispersion B1. The volume-average diameter (Mv), as measured with Nanotrac, was 275 nm, and the solid concentration was 22.6% by mass.

<Preparation of Polymer Primary Particles Dispersion B2>

A polymer primary particles dispersion B2 was produced in the same manner as that for the polymer primary particles dispersion B1, except that the wax dispersion A1 was changed to the wax dispersion A2. The volume-average diameter (Mv), as measured with Nanotrac, was 260 nm, and the solid concentration was 22.6% by mass.

<Preparation of Polymer Primary Particles Dispersion B3>

A polymer primary particles dispersion B3 was produced in the same manner as that for the polymer primary particles dispersion B1, except that the wax dispersion A1 was changed to the wax dispersion A3. The volume-average diameter (Mv), as measured with Nanotrac, was 257 nm, and the solid concentration was 22.3% by mass.

<Preparation of Polymer Primary Particles Dispersion B4>

A polymer primary particles dispersion B4 was produced in the same manner as that for the polymer primary particles dispersion B1, except that the wax dispersion A1 was changed to the wax dispersion A4. The volume-average diameter (Mv), as measured with Nanotrac, was 250 nm, and the solid concentration was 22.7% by mass.

<Preparation of Polymer Primary Particles Dispersion B5>

A polymer primary particles dispersion B5 was produced in the same manner as that for the polymer primary particles dispersion B1, except that the wax dispersion A1 was changed to the wax dispersion A5. The volume-average diameter (Mv), as measured with Nanotrac, was 246 nm, and the solid concentration was 22.8% by mass.

<Production of Toner Bk1 for Development>

| | |
|---|---|
| Polymer primary particles dispersion B1 (for core) | 90 parts as solid |
| Polymer primary particles dispersion B2 (for shell) | 10 parts as solid |

-continued

| | |
|---|---|
| Black colorant dispersion | 6 parts as colorant solid |
| Aqueous 20% DBS solution | 0.1 parts as solid |

Using the above-mentioned components, toner mother particles were produced according to the process mentioned below.

The polymer primary particles dispersion B1 (for core) and aqueous 20% DBS solution were put into a mixer (volume 12 liters, inner diameter 208 mm, height 355 mm) equipped with a stirrer (double-helical impeller), a heating and cooling unit, a condenser and a starting material/auxiliary agent feeder, and uniformly mixed at an internal temperature of 12° C. for 5 minutes.

Subsequently, while kept stirred at an internal temperature of 12° C., aqueous 5% ferrous sulfate solution was added thereto in an amount of 0.52 parts as $FeSO_4.7H_2O$, taking 5 minutes, and then the black colorant dispersion was added, taking 5 minutes, and uniformly mixed at an internal temperature of 12° C. Further still under the same condition, aqueous 0.5% aluminium sulfate solution (in which the solid content relative to the resin solid content was 0.10 parts) was dropwise added thereto.

Subsequently, this was heated up to an internal temperature of 53° C. taking 75 minutes, and further heated up to 56° C. taking 170 minutes. Using a multisizer, the volume median diameter (Dv50) was measured and was 6.7 μm. Subsequently, the polymer primary particles dispersion B2 (for shell) was added thereto, taking 3 minutes, and then kept as such for 60 minutes.

Subsequently, aqueous 20% DBS solution (6 parts as solid) was added thereto, taking 10 minutes, then heated up to 95° C. taking 30 minutes, and further kept stirred to have a mean circularity of 0.970 taking 120 minutes. Subsequently, this was cooled down to 30° C., taking 30 minutes, to give a slurry. In this, Dv50 of the particles was 7.08 μm, and the mean circularity thereof was 0.969.

The slurry was filtered under suction by an aspirator, using 5-species C filter paper (No5C by Toyo Filter Paper). The cake remaining on the filter paper was transferred into a stainless container having an inner volume of 10 L and equipped with a stirrer (propeller), 8 kg of ion-exchanged water having an electric conductivity of 1 μS/cm was added thereto and stirred at 50 rpm for uniform dispersion, and then kept stirred for 30 minutes.

Afterwards, this was filtered under suction by an aspirator, using 5-species C filter paper (No5C by Toyo Filter Paper). Again the solid remaining on the filter paper was transferred into a stainless container having an inner volume of 10 L, equipped with a stirrer (propeller) and containing therein 8 kg of ion-exchanged water having an electric conductivity of 1 μS/cm, and stirred at 50 rpm for uniform dispersion, and then kept stirred for 30 minutes. This step was repeated 5 times, and the electric conductivity of the filtrate reached 2 μS/cm.

The resultant cake was pressed into a stainless vat to have a height of 20 mm from the bottom of the vat, and dried in an air drier set at 40° C. for 48 hours to give toner mother particles.

100 parts (500 g) of the resultant toner mother particles were put into a 9-L Henschel mixer by Mitsui Mining, and then 2.0 parts of silica fine particles hydrophobized with hexamethyldisilazane and having a volume-average primary particle size of 0.10 μm, and 0.6 parts of silica fine particles hydrophobized with silicone oil and having a volume-average primary particle size of 0.012 μm were added thereto, mixed at 3500 rpm for 15 minutes, and sieved through a 200-mesh sieve to give a toner Bk1 for development <Production of Toner Cy1 for Development>

| | |
|---|---|
| Polymer primary particles dispersion B2 (for core) | 90 parts as solid |
| Polymer primary particles dispersion B2 (for shell) | 10 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy1 for development was produced in the same manner as that for the toner Bk1 for development except that the above-mentioned components were used. Dv50 of the mother particles slurry was 6.99 μm, and the mean circularity thereof was 0.970.

<Production of Toner Cy2 for Development>

| | |
|---|---|
| Polymer primary particles dispersion B1 (for core) | 80 parts as solid |
| Polymer primary particles dispersion B2 (for shell) | 20 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy2 for development was produced in the same manner as that for the toner Bk1 for development except that the above-mentioned components were used. Dv50 of the mother particles slurry was 6.89 μm, and the mean circularity thereof was 0.970.

<Production of Toner Cy3 for Development>

| | |
|---|---|
| Polymer primary particles dispersion B1 (for core) | 80 parts as solid |
| Polymer primary particles dispersion B2 (for shell) | 20 parts as solid |
| Cyan pigment dispersion (EP750 by Dainichiseika Color & Chemicals Mfg.) | 4.4 parts as colorant solid |
| Wax dispersion A2 | 2 parts as solid |
| Aqueous 20% DBS solution | 0.1 parts as solid |

A toner Cy3 for development was produced in the same manner as that for the toner Bk1 for development except that the above-mentioned components were used. Dv50 of the mother particles slurry was 7.02 μm, and the mean circularity thereof was 0.972.

<Production of Toner Cy4 for Development>

| | |
|---|---|
| Polymer primary particles dispersion B2 (for core) | 90 parts as solid |
| Polymer primary particles dispersion B2 (for shell) | 10 parts as solid |
| Cyan pigment dispersion (EP750 by Dainichiseika Color & Chemicals Mfg.) | 4.4 parts as colorant solid |
| Wax dispersion A2 | 2 parts as solid |
| Aqueous 20% DBS solution | 0.1 parts as solid |

A toner Cy4 for development was produced in the same manner as that for the toner Bk1 for development except that the above-mentioned components were used. Dv50 of the mother particles slurry was 6.90 μm, and the mean circularity thereof was 0.970.

<Production of Toner Cy5 for Development>

| | |
|---|---|
| Polymer primary particles dispersion B3 (for core) | 90 parts as solid |
| Polymer primary particles dispersion B3 (for shell) | 10 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy5 for development was produced in the same manner as that for the toner Bk1 for development except that the above-mentioned components were used. Dv50 of the mother particles slurry was 7.07 μm, and the mean circularity thereof was 0.972.

<Production of Toner Cy6 for Development>

| | |
|---|---|
| Polymer primary particles dispersion B1 (for core) | 90 parts as solid |
| Polymer primary particles dispersion B2 (for shell) | 10 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy6 for development was produced in the same manner as that for the toner Bk1 for development except that the above-mentioned components were used. Dv50 of the mother particles slurry was 7.01 μm, and the mean circularity thereof was 0.968.

<Production of Toner Cy7 for Development>

| | |
|---|---|
| Polymer primary particles dispersion B4 (for core) | 90 parts as solid |
| Polymer primary particles dispersion B4 (for shell) | 10 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy7 for development was produced in the same manner as that for the toner Bk1 for development except that the above-mentioned components were used. Dv50 of the mother particles slurry was 7.19 μm, and the mean circularity thereof was 0.971.

<Production of Toner Cy8 for Development>

| | |
|---|---|
| Polymer primary particles dispersion B5 (for core) | 90 parts as solid |
| Polymer primary particles dispersion B5 (for shell) | 10 parts as solid |
| Cyan pigment dispersion (EP750 by Dainichiseika Color & Chemicals Mfg.) | 4.4 parts as colorant solid |
| Aqueous 20% DBS solution | 0.1 parts as solid |

A toner Cy8 for development was produced in the same manner as that for the toner Bk1 for development except that the above-mentioned components were used. Dv50 of the mother particles slurry was 7.10 μm, and the mean circularity thereof was 0.971.

<Production of Toner Ma1 for Development>

| | |
|---|---|
| Polymer primary particles dispersion B1 (for core) | 80 parts as solid |
| Polymer primary particles dispersion B2 (for shell) | 20 parts as solid |

-continued

| | |
|---|---|
| Magenta pigment dispersion (EP1210 by Dainichiseika Color & Chemicals Mfg.) | 9 parts as colorant solid |
| Aqueous 20% DBS solution | 0.1 parts as solid |

A toner Ma1 for development was produced in the same manner as that for the toner Bk1 for development except that the above-mentioned components were used. Dv50 of the mother particles slurry was 6.85 μm, and the mean circularity thereof was 0.970.

<Production of Toner Ma2 for Development>

| | |
|---|---|
| Polymer primary particles dispersion B1 (for core) | 90 parts as solid |
| Polymer primary particles dispersion B2 (for shell) | 10 parts as solid |
| Magenta pigment dispersion (EP1210 by Dainichiseika Color & Chemicals Mfg.) | 9 parts as colorant solid |
| Aqueous 20% DBS solution | 0.1 parts as solid |

A toner Ma2 for development was produced in the same manner as that for the toner Bk1 for development except that the above-mentioned components were used. Dv50 of the mother particles slurry was 7.04 μm, and the mean circularity thereof was 0.973.

<Production of Toner Ma3 for Development>

| | |
|---|---|
| Polymer primary particles dispersion B2 (for core) | 90 parts as solid |
| Polymer primary particles dispersion B2 (for shell) | 10 parts as solid |
| Magenta pigment dispersion (EP1210 by Dainichiseika Color & Chemicals Mfg.) | 9 parts as colorant solid |
| Aqueous 20% DBS solution | 0.1 parts as solid |

A toner Ma3 for development was produced in the same manner as that for the toner Bk1 for development except that the above-mentioned components were used. Dv50 of the mother particles slurry was 7.13 μm, and the mean circularity thereof was 0.968.

<Production of Toner Ye1 for Development>

| | |
|---|---|
| Polymer primary particles dispersion B1 (for core) | 90 parts as solid |
| Polymer primary particles dispersion B2 (for shell) | 10 parts as solid |
| Yellow pigment dispersion (EP590 by Dainichiseika Color & Chemicals Mfg.) | 6 parts as colorant solid |
| Aqueous 20% DBS solution | 0.1 parts as solid |

A toner Ye1 for development was produced in the same manner as that for the toner Bk1 for development except that the above-mentioned components were used. Dv50 of the mother particles slurry was 6.92 μm, and the mean circularity thereof was 0.972.

<Production of Toner Ye2 for Development>

| | |
|---|---|
| Polymer primary particles dispersion B1 (for core) | 80 parts as solid |
| Polymer primary particles dispersion B2 (for shell) | 20 parts as solid |
| Yellow pigment dispersion (EP590 by Dainichiseika Color & Chemicals Mfg.) | 6 parts as colorant solid |
| Aqueous 20% DBS solution | 0.1 parts as solid |

A toner Ye2 for development was produced in the same manner as that for the toner Bk1 for development except that the above-mentioned components were used. Dv50 of the mother particles slurry was 6.91 μm, and the mean circularity thereof was 0.969.

<Production of Toner Ye3 for Development>

| | |
|---|---|
| Polymer primary particles dispersion B2 (for core) | 90 parts as solid |
| Polymer primary particles dispersion B2 (for shell) | 10 parts as solid |
| Yellow pigment dispersion (EP590 by Dainichiseika Color & Chemicals Mfg.) | 6 parts as colorant solid |
| Aqueous 20% DBS solution | 0.1 parts as solid |

A toner Ye3 for development was produced in the same manner as that for the toner Bk1 for development except that the above-mentioned components were used. Dv50 of the mother particles slurry was 7.06 μm, and the mean circularity thereof was 0.971.

The following Table 1 shows the results of the dust emission amount from each toner and the gloss value of each toner, as measured according to the measurement methods mentioned above. Here, the gloss value was measured on a solid image printed with a color page printer, ML9600PS (by Old Data).

TABLE 1

| | Dust emission amount (mg/h) | Gloss Value |
|---|---|---|
| Toner Cy1 for Development | 9.6 | 15.0 |
| Toner Cy2 for Development | 0.9 | 15.4 |
| Toner Cy3 for Development | 2.8 | 16.2 |
| Toner Cy4 for Development | 11.5 | 15.8 |
| Toner Cy5 for Development | 8.4 | 16.3 |
| Toner Cy6 for Development | 0.6 | 15.4 |
| Toner Cy7 for Development | 0.6 | 15.2 |
| Toner Cy8 for Development | 0.6 | 15.5 |

TABLE 1-continued

| | Dust emission amount (mg/h) | Gloss Value |
|---|---|---|
| Toner Ma1 for Development | 0.8 | 26.5 |
| Toner Ma2 for Development | 0.7 | 27.0 |
| Toner Ma3 for Development | 9.1 | 26.8 |
| Toner Ye1 for Development | 0.6 | 25.9 |
| Toner Ye2 for Development | 0.9 | 26.5 |
| Toner Ye3 for Development | 8.9 | 26.4 |
| Toner Bk1 for Development | 0.6 | 21.4 |

The following Table 2 shows the results of HOS resistance evaluation made according to the above-mentioned method. Table 2 also shows in which layer the toner for development was laminated on the printing paper just before the fixation step. This further shows the total dust emission amount, the value of A/C, and the mean gloss value (cyan, magenta, yellow).

TABLE 2

| on printing paper just before fixation step | Example 1 | Example 2 | Example 3 | Example 4 | Example 5 | Example 6 | Example 7 | Example 8 |
|---|---|---|---|---|---|---|---|---|
| 1st layer (uppermost layer = on the side of fixing unit) | Cy1 | Cy1 | Cy2 | Cy3 | Cy4 | Cy5 | Ma3 | Ye3 |
| 2nd layer | Ma1 | Ma2 | Ma1 | Ma1 | Ma1 | Ma1 | Cy6 | Ma2 |
| 3rd layer | Ye1 | Ye1 | Ye1 | Ye1 | Ye1 | Ye1 | Ye1 | Cy6 |
| 4th layer (lowermost layer = on the side of printing paper) | Bk1 | Bk1 | Bk1 | Bk1 | Bk1 | Bk1 | Bk1 | Bk1 |
| HOS Resistance Evaluation | ○ | ○ | ○Δ | ○Δ | ○ | ○ | ○ | ○ |
| Total Dust emission amount | 11.6 | 11.5 | 2.9 | 4.8 | 13.5 | 10.4 | 10.9 | 10.8 |
| A/C | 16.0 | 16.0 | 1.5 | 4.7 | 19.2 | 14.0 | 15.2 | 14.8 |
| Gloss Value (average of Cy, Ma, Ye) | 24.5 | 24.6 | 24.6 | 24.9 | 24.7 | 24.9 | 24.7 | 24.9 |
| on printing paper just before fixation step | Com. Exam. 1 | Com. Exam. 2 | Com. Exam. 3 | Com. Exam. 4 | Com. Exam. 5 | Com. Exam. 6 | Com. Exam. 7 | Com. Exam. 8 |
| 1st layer (uppermost layer = on the side of fixing unit) | Cy6 | Cy6 | Cy1 | Cy6 | Cy7 | Cy8 | Ma2 | Ye1 |
| 2nd layer | Ma1 | Ma3 | Ma3 | Ma3 | Ma3 | Ma3 | Cy1 | Ma3 |
| 3rd layer | Ye2 | Ye2 | Ye2 | Ye3 | Ye2 | Ye2 | Ye2 | Cy2 |
| 4th layer (lowermost layer = on the side of printing paper) | Bk1 | Bk1 | Bk1 | Bk1 | Bk1 | Bk1 | Bk1 | Bk1 |
| HOS Resistance Evaluation | XX | X | ○ | X | X | X | X | X |
| Total Dust emission amount | 2.9 | 11.2 | 20.2 | 19.2 | 11.2 | 11.2 | 11.8 | 11.2 |
| A/C | 0.7 | 0.7 | 10.7 | 0.1 | 0.7 | 0.7 | 0.8 | 0.7 |
| Gloss Value (average of Cy, Ma, Ye) | 24.8 | 24.9 | 24.8 | 24.9 | 24.8 | 24.9 | 24.8 | 24.7 |

Com. Exam.: Comparative Example

While the present invention has been described in detail and with reference to specific embodiments thereof, it will be apparent to one skilled in the art that various changes and modifications can be made therein without departing from the spirit and scope thereof. The present application is based upon a Japanese patent application filed on Sep. 28, 2012 (Patent Application 2012-217165) and a Japanese patent application filed on Jul. 2, 2013 (Patent Application 2013-139142), and all the contents thereof are incorporated herein by reference.

The invention claimed is:

1. An image forming method using at least four color toners of yellow, magenta, cyan and black, and comprising a fixation step of fixing a toner image on a recording medium using a fixing unit, wherein the total of a dust emission amount from each of the four color toners is less than 16 mg/h, and when, of the yellow toner, the magenta toner and the cyan toner, just before the fixation step, a dust emission amount from the toner to be the outermost layer on the recording medium is represented by A (mg/h), a dust emission amount from the toner to be the interlayer on the recording medium is represented by B (mg/h), a dust emission amount from the toner to be the lowermost layer on the recording medium is represented by C (mg/h), A/C is from 1.5 to 23.7, and A, B and C each satisfy the relationship of $0.9 \leq A < 14.2$, $0.6 \leq B < 14.2$ and $0.6 \leq C < 14.2$.

2. The image forming method according to claim 1, wherein the A/C is from 4.0 to 23.7.

3. The image forming method according to claim 1, wherein a mean gloss value in printing solid images of yellow, magenta cyan is from 22.0 to 60.0.

4. The image forming method according to claim 1, wherein at least one toner of the yellow, magenta, cyan and black toners contains a hydrocarbon wax.

5. The image forming method according to claim 1, wherein the toner to be the outermost layer on the recording medium just before the fixation step contains a paraffin wax, and the toner to be the lowermost layer on the recording medium just before the fixation step contains a microcrystalline wax.

6. An image forming device using at least four color toners of yellow, magenta, cyan and black, and having a fixation step of fixing a toner image on a recording medium using a fixing unit, wherein the total of a dust emission amount from each of the four color toners is less than 16 mg/h, and when, of the yellow toner, the magenta toner and the cyan toner, just before the fixation step, a dust emission amount from the toner to be the outermost layer on the recording medium is represented by A (mg/h), a dust emission amount from the toner to be the interlayer on the recording medium is represented by B (mg/h), a dust emission amount from the toner to be the lowermost layer on the recording medium is represented by C (mg/h), A/C is from 1.5 to 23.7, and A, B and C each satisfy the relationship of $0.9 \leq A < 14.2$, $0.6 \leq B < 14.2$ and $0.6 \leq C < 14.2$.

7. The image forming device according to claim 6, wherein the A/C is from 4.0 to 23.7.

8. The image forming device according to claim 6, wherein a mean gloss value in solid image printing with yellow, magenta cyan is from 22.0 to 60.0.

9. The image forming device according to claim 6, wherein at least one toner of the yellow, magenta, cyan and black toners contains a hydrocarbon wax.

10. The image forming device according to claim 6, wherein the toner to be the outermost layer on the recording medium just before the fixation step contains a paraffin wax, and the toner to be the lowermost layer on the recording medium just before the fixation step contains a microcrystalline wax.

* * * * *